US006286152B1

(12) United States Patent
Mooneyhan et al.

(10) Patent No.: US 6,286,152 B1
(45) Date of Patent: Sep. 11, 2001

(54) DESIGNERS FLUCTUATION LOOP

(76) Inventors: Betty Frances Mooneyhan, 206 Washington, Ave., Richland, MS (US) 39218; Mary Evelyn O'Conner, 3231 Old Brandon Rd., Pearl, MS (US) 39208

( * ) Notice: Subject to any disclaimer, the term of this patent is extended or adjusted under 35 U.S.C. 154(b) by 0 days.

This patent is subject to a terminal disclaimer.

(21) Appl. No.: 09/588,975

(22) Filed: Jun. 1, 2000

(51) Int. Cl.[7] ..... A41F 1/02; A41D 9/00
(52) U.S. Cl. ..... 2/266; 2/237
(58) Field of Search ..... 2/76, 220, 236, 2/238, 266, 237

(56) References Cited

U.S. PATENT DOCUMENTS

| | | | | |
|---|---|---|---|---|
| 701,252 | * | 5/1902 | Bandler . | |
| 1,018,012 | * | 2/1912 | Shapiro . | |
| 1,022,410 | * | 4/1912 | Freedman . | |
| 1,831,451 | * | 11/1931 | Jackson | 2/237 |
| 2,108,175 | * | 2/1938 | Miller | 2/237 |
| 2,216,030 | * | 9/1940 | Bardsley | 2/237 |
| 3,793,645 | * | 2/1974 | Kadison | 2/221 |
| 3,839,740 | * | 10/1974 | Tornberg | 2/237 |
| 4,164,044 | * | 8/1979 | Holmes | 2/237 |
| 4,580,298 | * | 4/1986 | Tuisl | 2/237 |
| 6,026,515 | * | 2/2000 | Nielson et al. | 2/244 |

* cited by examiner

*Primary Examiner*—John J. Calvert
*Assistant Examiner*—Alissa L. Hoey

(57) ABSTRACT

A loop for displaying a Trademark, Copyright Notice, Logo, or the like, on the waistband of a pair of pants, shorts, skirt or blue jeans of which is also used to expand the waistband by way of un-buttoning the button and looping the loop over the button to hold the waistband in an expanded position consisting of any suitable material of any length fixed into the button hole end-lip of the waistband so the wearer may use the loop for quick relief from an over eaten meal, while dieting (gaining a pound or two) without the purchase of a new garment to fit, during early pregnancy, water retention, while driving, sitting, or any uncomfortable waistband condition(s) and may have attached to the loop a chain or the like holder having a button hole plug of any suitable design attached onto the chain for the insertion of the exposed button hole when the loop is used to expand the waistband and/or decoration.

3 Claims, 6 Drawing Sheets

DESIGNERS FLUCTUATION LOOP

BACKGROUND OF THE INVENTION

1. Field of the Invention

The present invention relates to garment attachments for trademark and the like displays and waistband extensions that relief pressure from the waistline and fluctuates for the wearer from normal mode to loose weear.

2. Description of Prior Art

Heretofore, various garment attachments for Trademark, etc. displays, waistband extensions and waistband pressure relievers of pants, shorts, skirts, or blue jeans have been developed. None of these, however, have the single feature of combined uses of the present invention. Example:

SUMMARY

It is an object of the present invention to provide a novel waistband attachment loop for displaying Trademarks, and the like.

It is another object of the present invention to provide a waistband extension for use when the wearer gains a pound (men and women), retains fluid, or the like, suffers from a large intake of food (men and women), or wants to continue wearing the garment during early pregnancy (women); giving the wearer that added inch in the waistband, when desired; and returning the garment to normal mode when the wearer loses tat extra pound and such as above.

And yet, another object of the present invention Is to give the wearer an option of not buying a new garment that will meet the need of that extra pound or two ,or month or two in early pregnancy, or the like, to feel comfortable enough to wear without buying larger garments to meet the needs as mentioned above.

Yet, another object of the present Invention is the simplicity of use for the wearer.

Another object of the present invention is the simplicity of a zipper stay, a novel Trademark (etc.) display thats functional and a waistband extension and waistline reliever, all in one, very inexpensive and decorative, single loop.

And, another object of the present invention is to provide an attachment that can used in normal fashion (usual waistband) to a longer waistband by just looping a button and returning back to normal mode by rebuttoning, the button in the usual manner.

And, another object of the present invention is to provide a waistband that can expose the button hole for new fashion trends, or having a button plug, or the like, placed onto the loop before sewing to fill the exposed button hole when the loop is in use.

BRIEF DESCRIPTION OF THE DRAWING(S)

DESCRIPTION OF THE PREFERRED EMBODIMENTS

The multiple use waistband attachment(s) of the present invention described herein is used for a novel way to display Trademarks, Logos, or Copyright notices, and the like, on the waistband of a pair of pants, shorts, skirt, of blue jeans. Secondly, the waistband invention is used for extending the waistband of the garment for when the wearer diets (gaining a pound, losing a pound (men and women), retains water (women), or wants to continue wearing the garment a few months more during early pregnancy (women), or any waistline fluctuation the wearer may have, like over eating at lunch (men and women). Any, thirdly the present invention is also a new fashion for loose wear or an undressed look used in today's fashions.

The present invention may optionally include a chained, or the like, button hole insert plug, fixedly attached to the loop, perhaps place on the loop before it's insertion and fixation into the waistband. The button insert may be a button or any attractive ornament that will serve as a second button to fill in the expose button hole when the loop is in use.

Prior art such as U.S. Pat. No. 1,831,451 dated November 1931 by E. A.. JACKSON as having an inelastic belt through the waistband for extended the waistband and only made for men's wear. And, Tuisl U.S. Pat. No. 4,580,298 dated April 1986 shows a waistband attachment having a button eye on one end and a button on the other end and a zipper hook in the center. Neither of the above patents teaches an attachment for use for a trademark, or the like display. Nor, do they teach an waistband extenuation for use as a new fashion trend such as loose wear or the undressed look of today. Nor, do they teach any use for women during early pregnancy or dieting needs. Nor, do they eliminated the use of extra buttons and button hole eyelets or the lower cost of producing the same results for manufacturing cost as the present invention. Nor, do they show the simplicity of use with the same results.

The present invention consist of a flat or round strip of any suitable material, like a cord of elastic, a tubular turned strip of fabric, a strip of leather, a flat strip or round strip plastic, or the like, to form a full circle loop, or partial loop (shown in FIGS. 1, 2, and 3.) that is fixed (perhaps sown) into the waistband lip-end of the waistband material.

Figure 1:
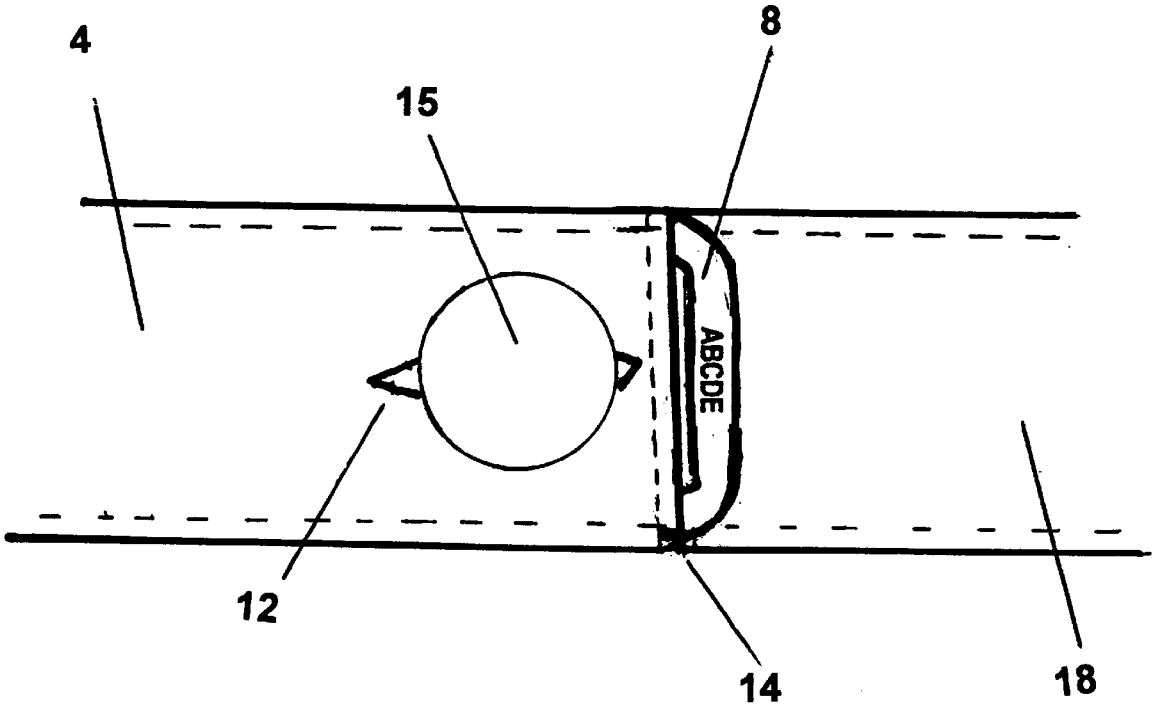
FIG. 1 is an enlarged perspective view of the present invention showing the attached loop on the button hole lip-end of a waistband having a simulated Trademark applied, thereto.

FIG. 1 of the present invention shows a novel Trademark, Copyright Notice, Logo ,or the like, display loop # 8 sewn, or the like, into the waistband # 4 button hole # 12 side lip-end # 14. The loop # 8 may be any length and of any suitable material. The loop # 8 may extend from the waistband or lie close to the lip-end # 14 made of elastic cording, or any sutible material.

Figure 2:
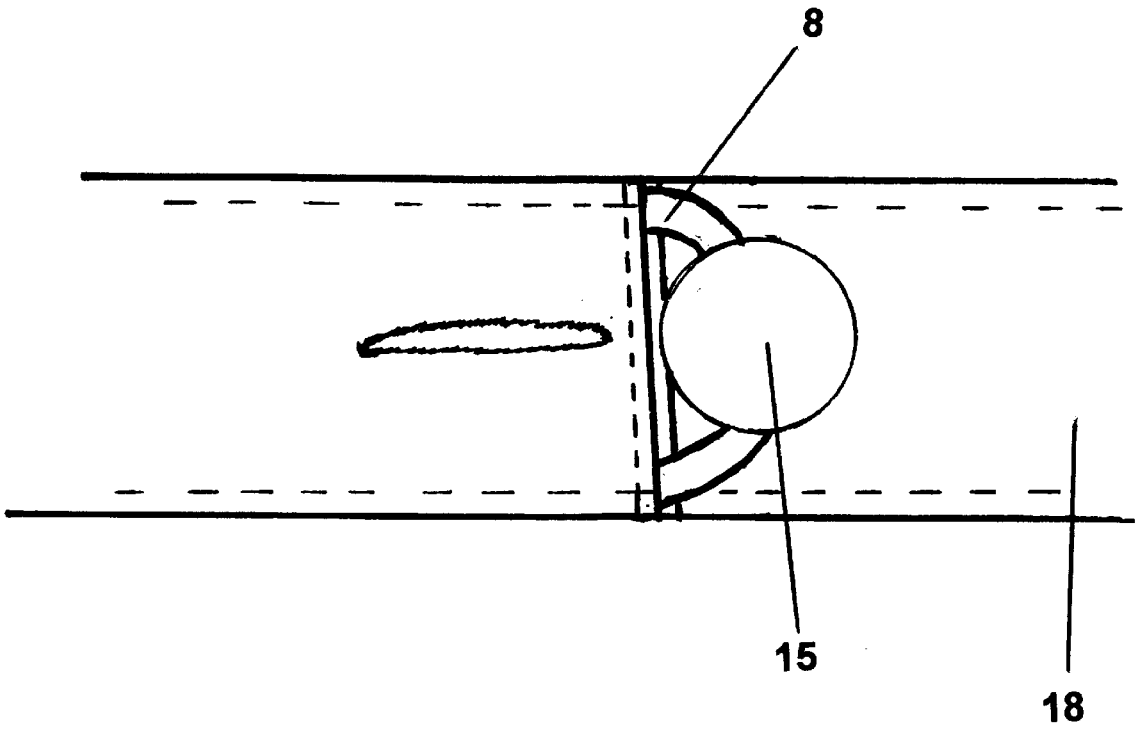
FIG. 2 is an enlarged perspective view of the present invention hooked over the button with the waistband extended.

FIG. 2 is a perspective view of the present invention's loop # 8 looped over the button # 15 holding the waistband # 18, securely.

Figure 3:
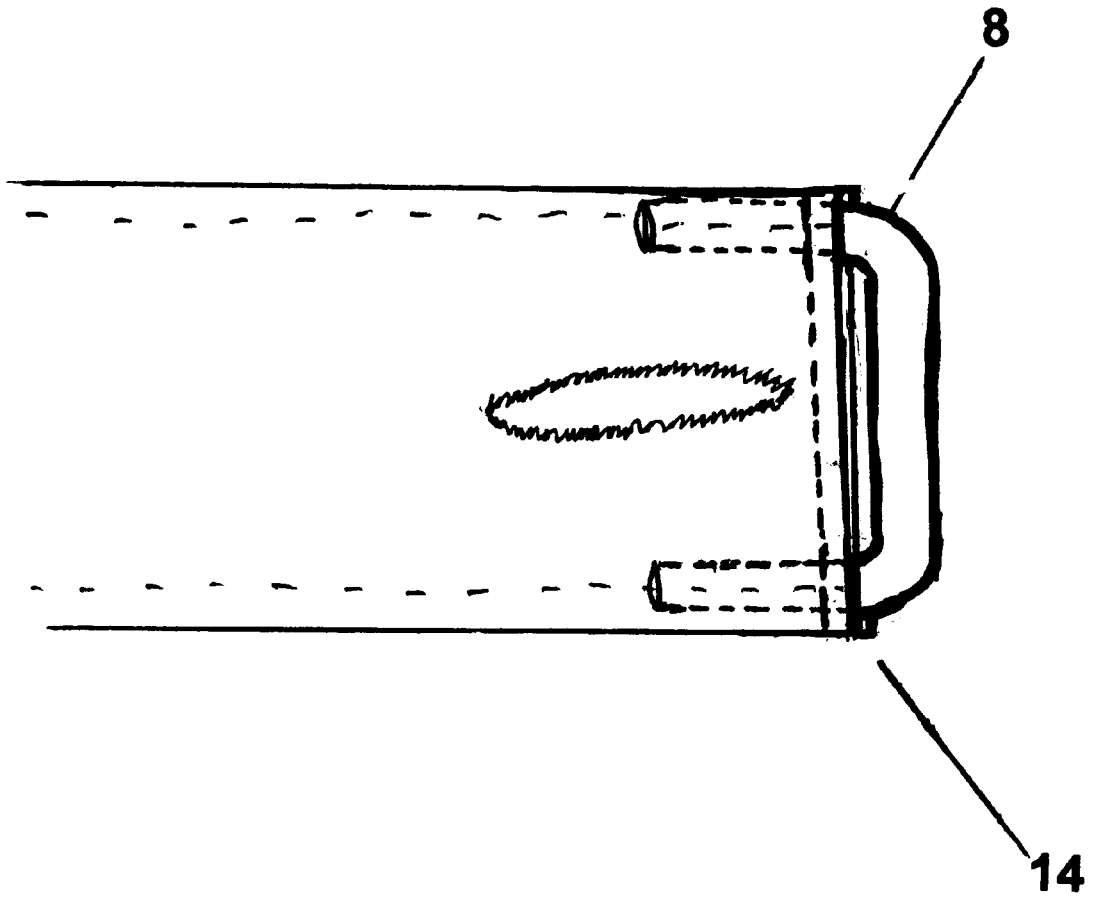
FIG. 3 is an enlarged sectional view of the loop sandwiched between the top and bottom portion of the lip-end button hole side of the waistband, fixed thereinto.

FIG. 3 is a sectional view of the loop # 8 inserting into the waistband # 14 lip-end # 14 and then is fixed thereinto by any suitable manner, perhaps sewing.

Figure 4:
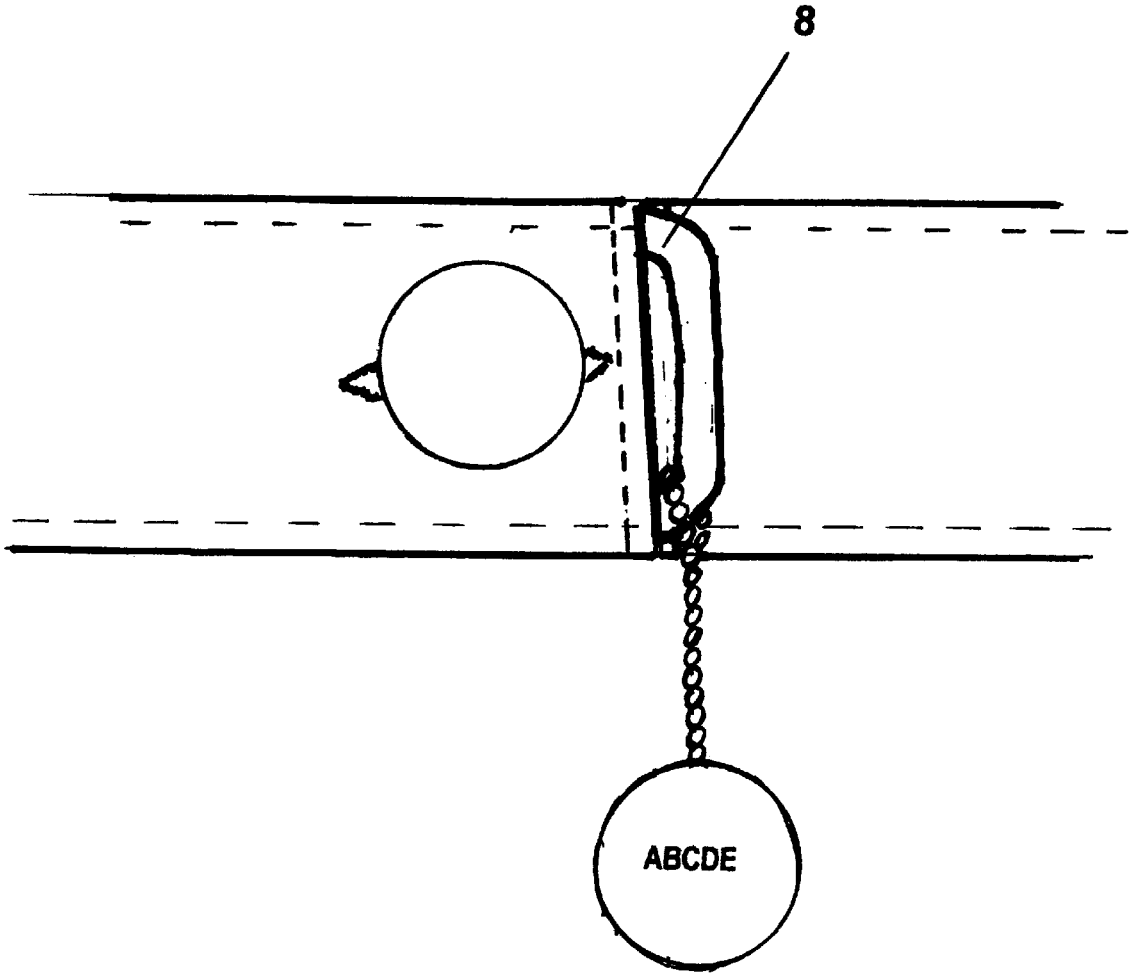
FIG. 4 is an enlarged perspective view of an example illustration of a chain, or the like, holding a button hole plug of any desired form for placing into the exposed button hole when the wearer chooses to extend the waistband.
Figure 5:
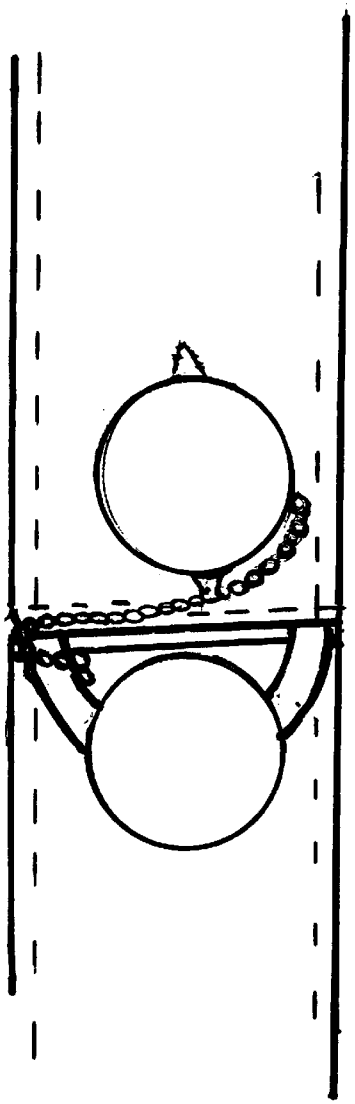
FIG. 5 is an enlarged illustrated view of the button hole plug inserted into the button hole when the wearer extends the waistband.

FIG. 4 shows an optional chain, or the like, attached to the loop # 8 and having a button plug of any desired form or design for placing into the exposed button hole (if desired) when the wearer extends the waistband (see, FIGS. 2 and 5).

FIG. 5 shows the optional chain and button plug of FIG. 4 in use with the waistband extended.

Figure 6:
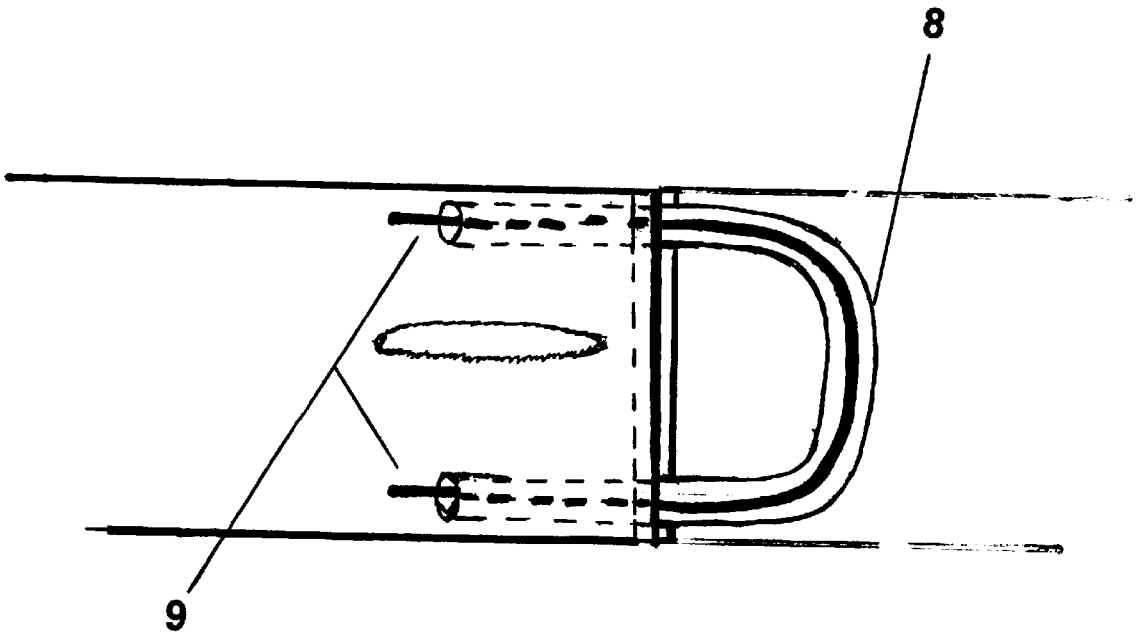
FIG. 6 is an enlarged illustrated view of the loop having an optional wire, or the like, inserted through the center of the tubing (if material is tubular) to give the loop flexibility so that it can be worn close to the wearer's body.

FIG. 6 is an enlarged sectional view of the loop # 8 showing the loop being tubular of any material and having a flexible wire # 9 inserted through the tubular material and sewn to the waistband in the same manner as above.

Let it be known to those skilled in the arts that the present invention can also have a wire inserted inside the tubular loop, or the like, so as to bend so that it can be worn closer to the waistband when not in use and that the loop can be made of elastic cord, or the like, and that the present loop is designed for waistband pressure point relief, like for an hour, or for a day, or month and then the user can resume the normal wear of the garment worn by placing the button back Into the original mode. Let it be known that covers, the use of a fake makeshift button, or the like, may be used to cover the exposed button hole ,or perhaps a flap or label may be used sown on the backside of the waistband having small snaps Nelcro, or the like, to cover the button hole by way of placing it to the front side of the waistband and snapping, or the like, covering the button hole with a trademark tag, flap. or any suitable means of covering the exposed button hole (See, FIGS. 4 and 5 for example ). The exposed button hole may be a useful catch-all for fashion designers. Therefore, the optional use of a button insert plug may want to be deleted for fashion sake. Although, the button hole may be of some concern to those skilled in the arts, perhaps they may want to think of young teens who like the undressed look in their clothing, like, wearing the waistline low on the hips with their underwear showing above the waistband of the pants and that lengthening the present inventive loop teens can wear the pants, etc. in a normal fashion on the waist or may wear the waistband low on the hips being that the longer loop can be passed through the belt loops of pants treaded like a belt when the loop is not in use, a so called Hip Hoppers™ kind of fashion that can be worn two ways, high and low, and may include the shorts/undershorts as a unit with the pants.

The applicant knows that many modifications can easily and readily be made to detour the intended spirit and scope of the present invention and that no known prior art to her knowledge has place a loop for the enclosed combined uses, at the edge end lip of a waistband with a single loop of fabric, or the like. Therefore, the present invention should no be so limited that additional means of covering the button hole would limit the invention. And perhaps, that other ornaments like, key chain like, trinkets, or the like, may be placed on the present invention before the above loop is sown into the waistband shown for ornamentation ,or plugging the button hole (see, FIGS. 4 and 5).

The applicant herewith, prays that Unrecognized Problems women have with bodily fluctuation, like monthly weight gain caused by water retention and bloating, dieting weight fluctuation (gain a pound, lose a pound), swelling of the stomach during the early stages of pregnancy, and simple eating too much at one time, would give the present invention ample means to solve the above problems women have, with clothing.

The applicant herewith, also prays, that the Lack of Implementation of these problems stated above with waistband pressure has not been used commercially and should be included within the spirit and scope of the present invention.

The applicant herewith, prayerfully, has invented (new uses) the simple waistband fluctuation loop (waistband reliever/extension, display, and zipper stay) with uses that has been unexpected for use, unsuggested by any prior known to her and that the present invention has workable and surprising result when use in the proper manner as mentioned, herein.

We claim:

1. A waist band extender in combination with a waist band comprising:

the waist band having a generally elongated rectangular configuration, the elongated configuration having two ends situated across the short ends of the rectangle, one of the ends being a button end the other end being a buttonhole end;

an attached loop affixed to the button hole end and extending from the rectangle waist band and sized to receive a button; and indicia affixed to the attached loop.

2. The waist band extender and waist band combination of claim 1 wherein said loop is made out of an elastic material.

3. The waist band extender and waist band combination of claim 1 wherein said waist band and said loop are made out of the same material.

* * * * *